United States Patent [19]

Littlefield

[11] 4,076,151

[45] Feb. 28, 1978

[54] COMBINED SEALING AND POURING SPOUT ASSEMBLY

[75] Inventor: Herrick B. Littlefield, Darien, Conn.

[73] Assignee: Polyproducts Corporation, Long Island City, N.Y.

[21] Appl. No.: 719,409

[22] Filed: Sep. 1, 1976

Related U.S. Application Data

[63] Continuation of Ser. No. 550,914, Feb. 19, 1975, abandoned.

[51] Int. Cl.[2] ..... B65D 47/10

[52] U.S. Cl. ..... 222/525; 222/541

[58] Field of Search ..... 220/27, 54, 855; 222/523, 525, 541, 548, 549, 538

[56] References Cited

U.S. PATENT DOCUMENTS

| | | | |
|---|---|---|---|
| 3,063,604 | 11/1962 | Malpas | 222/525 |
| 3,172,573 | 3/1965 | Parish, Jr. et al. | 222/525 X |
| 3,659,757 | 5/1972 | Tini | 222/541 |
| 3,804,305 | 4/1974 | Rieke | 222/541 X |

*Primary Examiner*—Robert B. Reeves

*Attorney, Agent, or Firm*—Curtis, Morris & Safford

[57] ABSTRACT

A combined sealing and pouring spout assembly for use on containers for liquid wherein the assembly includes a neck or carrier plug adapted to be secured within an orifice in the liquid container and a spout member telescopically received therein. A screw cap closure is provided to be threadably engaged on the exposed end of the spout member and initially the screw cap member is sealed to the carrier plug. In use, after the seal has been removed the screw cap closure is removed and the spout extended to permit pouring of the liquid in the liquid container.

6 Claims, 3 Drawing Figures

COMBINED SEALING AND POURING SPOUT ASSEMBLY

This is a continuation of application Ser. No. 550,914 filed Feb. 19, 1975, now abandoned. The present invention relates to pouring spouts for liquid containers and more particularly relates to pouring spouts for liquid containers which may be preassembled prior to installation on a liquid container to seal the container and also provide a withdrawable spout member to facilitate pouring of the liquid from the container.

Where large containers are to be used for the storage of liquids which must be poured from the container it is desirable to provide some means to incorporate a spout to facilitate pouring of the liquid. Without a spout, handling of the container while pouring the liquid is difficult and the liquid spills over the top of the container.

It is also desirable to provide liquid containers with a pouring orifice which may be presealed to insure that the contents of the container have not been tampered with or to insure that the container is properly sealed to preclude foreign matter and the like from entering the container.

Accordingly, it is an object of the present invention to provide a sealable and reusable sealing closure for a liquid container which also includes a spout member to facilitate pouring of the liquid from the container.

It is a further object of the present invention to provide such a sealing member and pouring spout combined in a single unit which may be readily manufactured and installed in the container when the container is filled with liquid.

It is a further object of the present invention to provide a combined liquid container sealing member and pouring spout wherein the spout is telescopically housed in conjunction with the sealing member so that after use, the spout may be telescoped within the container and the container resealed for subsequent use.

In accordance with these and other objects of the present invention a spout member is telescopically housed within a carrier plug member which is fixed in any suitable manner in an end wall of a liquid container. A screw cap closure is provided which threadably engages an appropriate segment of the carrier plug and the spout telescopically housed therein to permit sealing and unsealing of the assembly when it is desired to pour liquid from the container. Initially, a removable sealing ring is provided to seal the screw cap closure to the carrier plug so that in effect the screw cap closure is bonded to the carrier plug until the seal is removed.

With reference to the accompanying drawing.

Figure 1:
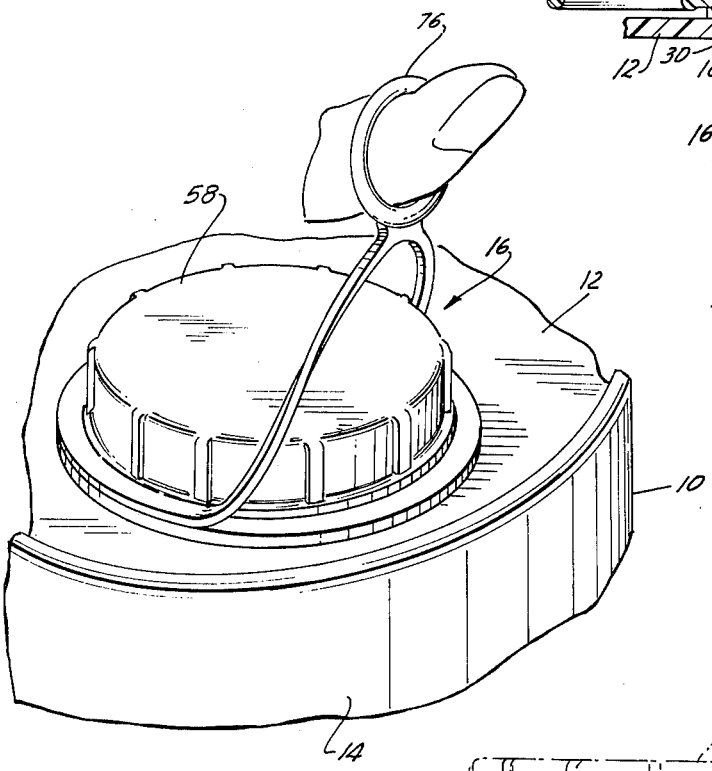
FIG. 1 is a perspective view showing the closure and spout assembly of the present invention as it is installed on the top of a liquid container.

With reference to the drawing, a liquid container 10 is shown which includes a top wall 12, a side wall 14, shown illustratively as a cylindrical segment but which may also be a rectangular or square segment, and a bottom wall (not shown) to complete the container. The pouring spout assembly 16 of the present invention is mounted within a suitable orifice 18 in the top wall 12 of liquid container 10.

Pouring spout assembly 16 includes a carrier plug 20 adapted to be secured to top cover 12 of the liquid container 10 within orifice 18. The carrier plug 20 comprises a substantially cylindrical wall segment 22 having an upper end segment 24 which extends above container top wall 12 and a lower end segment 26 which extends into liquid container 10. Intermediate ends 24 and 26 a circumferential extending flange member 28 is provided which rests on the outer surface of container wall 12. Carrier plug 20 is secured to the container wall 12 in any convenient manner, for example by mechanical interference fit, bonding or ultrasonically welding flange 28 to container wall 12 or, where the carrier plug is made from a material such as a resilient plastic material, by providing a circumferential notch 30 in the exterior surface of carrier plug 20 below flange 28 to receive a circumferential segment of the liquid container wall 12 therein.

The interior surface of the upper end segment 24 of the carrier plug 20 is notched, as at 32, to define a ledge 34 spaced below the upper surface of the carrier plug 24. In like manner, the lower interior surface of lower end segment 26 includes a notch 36 to define a ledge 38. Ledges 34 and 38 of carrier plug 20 cooperate with a pouring spout member as will be explained more fully hereinbelow.

Figure 2:
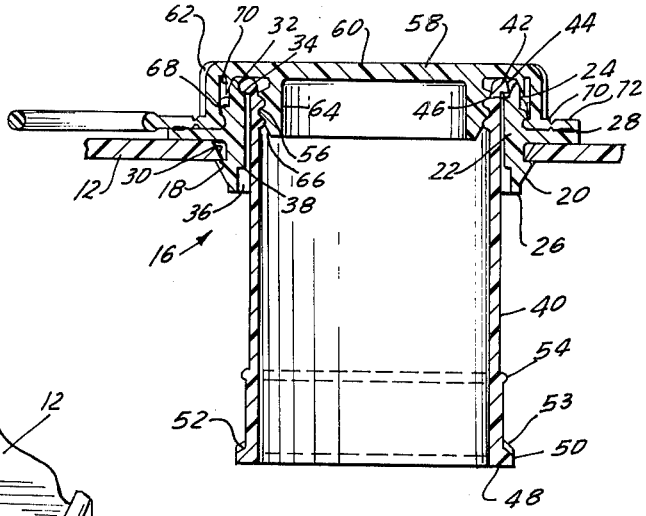
FIG. 2 is a vertical sectional view showing the closure and pouring spout of the present invention with the pouring spout telescoped within the liquid container.
Figure 3:
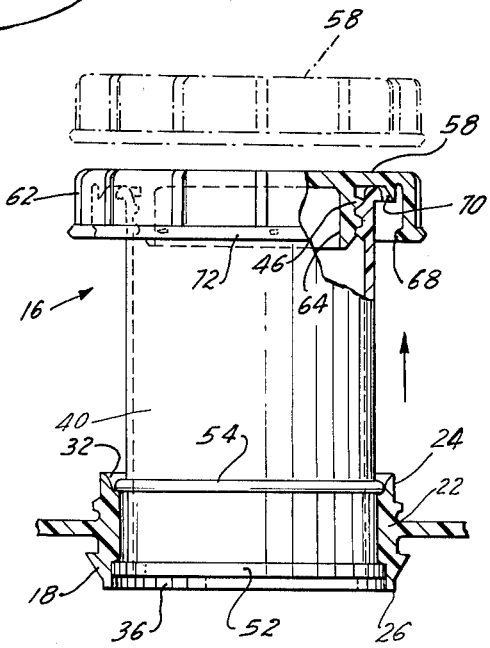
FIG. 3 is a view similar to FIG. 2 showing the pouring spout withdrawn from the liquid container.

A pouring spout 40 is telescopically disposed within carrier plug 20. Pouring spout 40 is a substantially cylindrical member having an axial length significantly greater than the axial length of carrier plug 20. The upper end 42 of pouring spout 40 is provided with a flanged extension 44 defining an undersurface ledge 46 which cooperates with ledge 34 on carrier plug 20 to support the pouring spout 40 when the spout is in its nesting position as illustrated in FIG. 2. The lower end 48 of pouring spout 40 is provided with an extending flange 50 which defines an undersurface ledge 52 which cooperates with ledge 38 of carrier plug 20 when pouring spout 40 is in its extended or pouring position as illustrated in FIG. 3. Ledge 52 is formed with a downwardly and outwardly extending slope and is provided with circumferentially spaced ribs 53 extending slightly above the surface of ledge 52. When spout member 40 is in the extended position, illustrated in FIG. 3, the angled slope of ledge 52 and ribs 53 cooperate with the mating ledge 38 to effectively hold spout member 40 in the elevated position and preclude relative rotation of the spout member relative to carrier plug 20.

Spaced axially inwardly from end 48 of pouring spout 40 is a slight nodular protrusion 54 about the periphery of pouring spout 40. The axial distance between ledge 52 and protrusion 54 is substantially the same as the axial distance between ledges 34 and 38 on carrier plug 20. The radially outward extension of protrusion 54 is such as to allow the protrusion to pass through the opening within carrier plug 20 and cooperates with ledge 34, when pouring spout 40 is in the extended or pouring position of FIG. 3, to retain and hold the pouring spout in its extended liquid-pouring position.

Pouring spout 40 is also provided, adjacent its upper end 42, with an internal screw thread form 56 formed on the internal wall surface of the pouring spout. As will be explained more fully hereinbelow, screw thread 56 cooperates with a screw cap closure.

A screw cap closure 58 is also provided for the pouring spout assembly 16 and includes a wall member 60, which is circular in cross-section, from which integrally depends a first wall member 62 and a second wall member 64 spaced radially inwardly from the first wall member 62. The exterior surface of depending wall member 64 is provided with an external screw thread configuration 66 complimentary to the internal thread configuration 56 on pouring spout 40 to threadably engage the screw cap closure 60 on pouring spout 40.

The screw cap closure 60 is threadably engaged with the pouring spout 40. To secure the screw cap closure 60, with the pouring spout 40 threadably engaged therein, to the carrier plug provision is made to enable cooperative interlocking between the screw cap closure 60 and the carrier plug. To this end spaced lugs 67 are provided near the lower end of the first wall member 62 extending inwardly from the interior surface of the wall member. Preferably four lugs 67 are provided spaced 90° apart. In addition on the exterior surface of carrier plug 20 a partial interrupted screw form 68 is provided. Screw form 68 is interrupted in four places to permit the lugs 67 on the screw cap closure to pass freely through the spaces between the interrupted screw form. After the lugs 67 are below the interrupted screw form 68, the cap is twisted in a direction so that the screw form 68 directs the screw cap closure downwardly in close abutting relationship to carrier plug 20.

An effective seal between the screw cap closure 58 and the carrier plug 20 is maintained by providing a depending sealing member 70 extending downwardly from wall 60 between depending walls 62 and 64. Sealing means 70 cooperates with the upper surface of the carrier plug 20 when the screw cap closure 58 is fully engaged in sealing relationship on the carrier plug 20 to provide an effective seal.

The sealing and pouring spout assembly 16 is initially provided with a flanged extension 72 extending outwardly from the first depending wall 62 of the screw cap closure 58 at its lower end thereof. The flanged extension 72 is notched about the periphery as at 74 adjacent the juncture of the flanged extension 72 and depending wall 62 and a finger ring 76 extending from flanged extension 72 is included. The flanged extension 72 is bonded, in any convenient manner, to the flanged extension 28 of carrier plug 20 to effectively seal the screw cap closure to the carrier plug thus providing an effective seal precluding unauthorized tampering with the contents of the container and an effective seal to preclude entry of foreign matter into the container.

In order to first use the pouring spout the finger ring 76 is grasped and pulled upwardly, in the manner shown in FIG. 1, causing the flanged extension to separate at the notched area 74 breaking the bond with carrier plug 20 to release the screw cap closure so that the spout may be elevated, the screw cap closure may be twisted off and the pouring spout used.

The screw cap closure is then rotated and as the screw cap closure is rotated lugs 67 align with the openings between the screw forms 68 and the pouring spout is then pulled upwardly as shown in FIG. 3 until the nodular segment 54 rests upon ledge 34 of the carrier plug 20. At this juncture the screw cap closure 58 is disengaged by unscrewing, as shown in broken line in FIG. 3, and liquid may be readily poured from the container 10 through the now extended pouring spout to preclude unwanted spillage. To reseal the container, screw cap closure 58 is threadably engaged on pouring spout 40. If desired, the pouring spout may be reinserted into the container by telescoping it within the carrier plug 20. As the screw cap closure is rotated, lugs 67 automatically align with the openings in the screw form 68 and the screw cap closure and carrier plug are rotated to firmly and sealingly engage the screw cap closure within the carrier plug 20.

It is thus seen that the present invention provides a combined sealing and pouring spout assembly to provide an effective means to seal a liquid container and also provide a convenient means to house a telescopically engaged pouring spout therein to facilitate pouring of liquid from the container.

What is claimed is:

1. A combined sealing and pouring spout assembly for a container comprising:

a carrier plug member adapted to be secured within an access opening in said container, said carrier plug member including an opening therethrough, a spout member telescopically received within said carrier plug opening and movable from a first position wherein a first end of said spout member is disposed within a plane substantially coextensive with the exterior surface of said carrier plug and a second position wherein said first end of said spout member is removed from said exterior surface of said carrier plug, removable and replaceable sealing means engageable with both said spout member to seal said spout member to preclude fluid access from within said container and with said carrier plug when said spout member is in said first position to secure said sealing means to said carrier plug to retain said spout member secured within said carrier plug, said removable sealing means comprising a screw cap closure member including an end wall member and a depending wall member extending from said end wall member, said depending wall member provided with a screw thread form engageable with a mating screw thread form formed adjacent said first end of said spout member, said screw cap closure including a depending member extending from said end wall member and radially spaced from said depending wall member, said depending member including means cooperable with said carrier plug to sealingly secure said screw cap closure to said carrier plug, and said carrier plug including an interrupted screw form thereon and wherein said means on said depending member of said screw cap closure includes an extending lug member adapted to fit between the interruption of said screw form and then be threadably engageable with said carrier plug to secure said screw cap closure on said carrier plug.

2. A combined sealing and pouring spout assembly as defined in claim 1 including severable sealing means provided about said screw cap closure to initially seal said screw cap closure to the exterior surface of said carrier plug.

3. A combined sealing and pouring spout assembly for a container comprising:

a carrier plug member adapted to be secured within an access opening in said container, said carrier plug including a substantially cylindrical opening therethrough affording a fluid access passage from the interior of said container to the exterior, a substantially cylindrical spout member having an axial length greater than the axial length of said carrier plug telescopically disposed within said carrier plug opening and movable from a first position wherein a first end of said spout is substantially coextensive with the exterior surface of said carrier plug to a second position wherein said first end of said spout member is removed from said exterior surface of said carrier plug, removable and replaceable sealing means engageable with both said spout member to seal said spout member to preclude fluid access from within said container and with said carrier plug when said spout member is in said first position to secure said sealing means to said carrier plug to retain said spout member secured within said carrier plug, said sealing means comprising a screw cap closure member including an end wall and a first depending wall member spaced radially inwardly from the peripheral extent of said end wall member, said first depending wall member provided with an external screw thread form along its radially outermost surface and the internal surface of said spout member adjacent said first end provided with an internal screw thread form complimentary to the screw thread form on said first depending wall member of said screw cap closure whereby said screw cap closure is cooperatively engageable with said spout member, said screw cap closure including a second depending wall member spaced radially outwardly from said first depending wall member, said depending wall member provided with means to engage means on said carrier plug to secure said screw cap closure on said carrier member in sealing relationship, and said engagement means on said second depending wall of said screw cap closure including at least one lug member extending radially inward from the interior surface of said wall and said securing means on said carrier plug comprises an interrupted screw thread form on the exterior surface of said carrier plug to axially and slidably receive the lug member from said screw cap closure through the interruption in the screw form whereby rotation of said screw cap closure sealingly engages said screw cap closure on said carrier member.

4. A combined sealing and pouring spout assembly as defined in claim 3 wherein the wall surface defining said opening through said carrier plug includes means cooperable with means on the exterior surface of said pouring spout to retain said pouring spout in said second position to facilitate pouring of ingredients from said container.

5. A combined sealing and pouring spout assembly as defined in claim 4 wherein said means on said carrier plug cooperable with said pouring spout comprises a notch adjacent the exterior surface of said carrier plug defining a ledge around the periphery of said wall surface, said spout member provided with protuberance means axially spaced from its other end adapted to cooperatively engage said ledge to retain said pouring spout in said second position.

6. A combined sealing and pouring spout assembly as defined in claim 3 wherein means are provided on said screw cap closure between said first and second depending walls to sealingly engage said carrier plug when said spout member is secured in said first position.

* * * * *